US010060240B2

(12) United States Patent
Friesen et al.

(10) Patent No.: US 10,060,240 B2
(45) Date of Patent: Aug. 28, 2018

(54) SYSTEM AND METHOD FOR FACILITATING SUBTERRANEAN HYDROCARBON EXTRACTION WITH ELECTROCHEMICAL PROCESSES

(71) Applicants: Cody Friesen, Fort Mcdowell, AZ (US); Jason Rugolo, Scottsdale, AZ (US)

(72) Inventors: Cody Friesen, Fort Mcdowell, AZ (US); Jason Rugolo, Scottsdale, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 0 days.

(21) Appl. No.: 14/776,252

(22) PCT Filed: Mar. 12, 2014

(86) PCT No.: PCT/US2014/024699

§ 371 (c)(1),
(2) Date: Sep. 14, 2015

(87) PCT Pub. No.: WO2014/159676

PCT Pub. Date: Oct. 2, 2014

(65) Prior Publication Data

US 2016/0040519 A1 Feb. 11, 2016

Related U.S. Application Data

(60) Provisional application No. 61/783,808, filed on Mar. 14, 2013.

(51) Int. Cl.

| | |
|---|---|
| ***E21B 43/26*** | (2006.01) |
| ***E21B 43/24*** | (2006.01) |
| ***E21B 43/247*** | (2006.01) |

(52) U.S. Cl.
CPC ..... *E21B 43/2401* (2013.01); *E21B 43/2405* (2013.01); *E21B 43/247* (2013.01); *E21B 43/26* (2013.01)

(58) Field of Classification Search
CPC ..... E21B 43/2401; E21B 43/247; E21B 43/26
See application file for complete search history.

(56) References Cited

U.S. PATENT DOCUMENTS

| | | | |
|---|---|---|---|
| 1,784,214 | A | 12/1930 | Workman |
| 2,799,641 | A | 7/1957 | Bell |

(Continued)

FOREIGN PATENT DOCUMENTS

| | | |
|---|---|---|
| EP | 2 212 516 | 12/1916 |
| WO | WO 2011/044612 | 4/2011 |

(Continued)

OTHER PUBLICATIONS

International Search Report and Written Opinion for Application No. PCT/US14/24699, dated Jul. 18 2014.

(Continued)

*Primary Examiner* — Silvana C Runyan
(74) *Attorney, Agent, or Firm* — Norton Rose Fulbright US LLP

(57) ABSTRACT

This disclosure includes systems and methods for extracting hydrocarbons from a geologic structure. Some systems use or include a well-bore that extends at least partially through the geologic structure, a first electrode disposed within the wellbore, an ionically conductive medium in fluid communication with the first electrode, a second electrode in electrical communication with the first electrode, and a power source configured to establish an electrical current between the first and second electrodes to cause an electrochemical reaction. Some systems are configured to facilitate extraction of hydrocarbons from a geologic structure.

25 Claims, 4 Drawing Sheets

(56) References Cited

U.S. PATENT DOCUMENTS

| | | | | |
|---|---|---|---|---|
| 3,141,504 | A | 7/1964 | Sarapuu | |
| 3,211,220 | A | 10/1965 | Sarapuu | |
| 3,916,993 | A | 11/1975 | Katz | |
| 4,037,655 | A * | 7/1977 | Carpenter | E21B 36/00 166/245 |
| 4,084,638 | A | 4/1978 | Whiting | |
| 4,199,025 | A | 4/1980 | Carpenter | |
| 4,463,805 | A * | 8/1984 | Bingham | E21B 43/2401 166/248 |
| 4,473,114 | A | 9/1984 | Bell et al. | |
| 4,553,592 | A * | 11/1985 | Looney | E21B 43/2401 166/248 |
| 4,567,945 | A * | 2/1986 | Segalman | E21B 17/003 166/248 |
| 4,662,438 | A | 5/1987 | Taflove et al. | |
| 6,148,911 | A | 11/2000 | Gipson et al. | |
| 6,705,425 | B2 | 3/2004 | West | |
| 6,877,556 | B2 | 4/2005 | Wittle et al. | |
| 7,325,604 | B2 | 2/2008 | Wittle et al. | |
| 7,631,691 | B2 | 12/2009 | Symington et al. | |
| 8,157,981 | B2 | 4/2012 | Peters et al. | |
| 2002/0141288 | A1 | 10/2002 | West | |
| 2005/0199387 | A1* | 9/2005 | Wittle | E21B 43/2401 166/248 |
| 2006/0118305 | A1 | 6/2006 | East, Jr. et al. | |
| 2007/0131422 | A1 | 6/2007 | Gatlin et al. | |
| 2008/0183451 | A1 | 7/2008 | Weng et al. | |
| 2008/0230219 | A1* | 9/2008 | Kaminsky | E21B 36/04 166/248 |
| 2011/0192593 | A1 | 8/2011 | Roddy et al. | |
| 2011/0203797 | A1 | 8/2011 | Alexandrov et al. | |
| 2011/0277992 | A1 | 11/2011 | Grimes | |
| 2011/0278012 | A1* | 11/2011 | Marino | C09K 8/52 166/311 |
| 2012/0273190 | A1 | 11/2012 | Thomas et al. | |
| 2012/0279713 | A1 | 11/2012 | Leon et al. | |
| 2012/0298527 | A1 | 11/2012 | James et al. | |
| 2013/0026978 | A1* | 1/2013 | Cooley | H01M 10/052 320/107 |
| 2013/0206400 | A1 | 8/2013 | Alexandrov et al. | |
| 2013/0312957 | A1 | 11/2013 | Grimes | |
| 2016/0333254 | A1 | 11/2016 | Friesen et al. | |
| 2017/0284180 | A1 | 10/2017 | Switzer et al. | |

FOREIGN PATENT DOCUMENTS

| | | |
|---|---|---|
| WO | WO 2012/025150 | 3/2012 |
| WO | WO 2013/055851 | 4/2013 |
| WO | WO 2014/159676 | 10/2014 |
| WO | WO 2015/105746 | 7/2015 |
| WO | WO 2016/037094 | 3/2016 |

OTHER PUBLICATIONS

International Search Report and Written Opinion for Application No. PCT/US2015/010116, dated Apr. 23, 2015.

International Search Report and Written Opinion for Application No. PCT/US2015/048615, dated Nov. 26, 2015.

Petrovic; "Reaction of Aluminum with Water to Produce Hydrogen: A Study of Issues Related to the Use of Aluminum for On-Board Vehicular Hydrogen Storage," U.S. Department of Energy, 2008, 1-26.

* cited by examiner

SYSTEM AND METHOD FOR FACILITATING SUBTERRANEAN HYDROCARBON EXTRACTION WITH ELECTROCHEMICAL PROCESSES

CROSS-REFERENCE TO RELATED APPLICATION

This application is a national phase application under 35 U.S.C. § 371 of International Application No. PCT/US2014/024699, filed Mar. 12, 2014, which claims priority to U.S. Provisional Patent Application No. 61/783,808 filed Mar. 14, 2013, the contents of each of which are incorporated by reference in their entirety.

FIELD OF INVENTION

The disclosed subject matter is generally related to extraction of subterranean hydrocarbons, and more specifically, but not by way of limitation, to the use of electrochemical processes to facilitate hydrocarbon extraction and fracturing of subterranean formations including hydrocarbons.

BACKGROUND

Hydrocarbons (e.g., petroleum, natural gas) are one of the principal energy sources utilized by current civilizations. Extraction of subterranean hydrocarbons can be achieved through two principal types of processes: primary recovery and supplementary (e.g. secondary, tertiary) recovery. Primary recovery generally refers to hydrocarbon extraction through the natural energy prevailing in a wellbore. Supplementary recovery generally refers to hydrocarbon extraction through the addition of various forms of energy into a wellbore. Historically, primary recovery methods were economically satisfactory and thus hydrocarbon extraction was generally facile. As a result of worldwide oil field maturation and increasing demand, the development of supplementary recovery methods has become increasingly important. In recent years, supplementary recovery of natural gas from shale formations has increased due to advances in wellbore engineering. For example, horizontal drilling technology has advanced, allowing the horizontal drilling of distances greater than a mile. In addition, advanced fracturing techniques used in horizontally-drilled wellbores have increased natural gas production from shale formations.

Induced fracturing of geologic structures containing subterranean hydrocarbons can conventionally be performed via hydraulic fracturing. Hydraulic fracturing generally propagates fractures within hydrocarbon-trapping formations by a pressurized fluid, thus creating conduits through which natural gas and petroleum may flow to the surface.

Hydraulic fracturing can have several disadvantages and limitations. Prominently, hydraulic fracturing may pose environmental risks associated with the migration of the fracturing fluid and chemical components contained therein. The hydraulic fracturing fluid may also result in contamination of groundwater or other surface formations, for example, as a result of spills and flowback. Previously known processes of hydraulic fracturing can also require effort with limited control each time it is desired to induce fractures. Additionally, it can be difficult to monitor the hydraulic fracturing process and characteristics of the hydrocarbon-rich formation after fracturing. The hydraulic fracturing process can also be expensive energetically and may be a generally inefficient method for fracturing the resource.

SUMMARY

Systems and methods are provided to facilitate extraction of subterranean hydrocarbons from geologic structures with the use of electrochemical processes both directly and indirectly. In some embodiments, electrochemical reactions may create high (e.g., or increase) subterranean pressures and/or heat. Additionally, electrochemical reaction products themselves, or follow-up processes involving electrochemical reaction products may enhance extraction of subterranean hydrocarbons. In some embodiments, hydrocarbon extraction may be regulated in a plurality of operation modes. In some embodiments, electrochemical processes may be used to induce fractures within shale formations containing natural gas.

Some embodiments of the present systems are configured to induce fractures in at least a portion of a geologic structure to facilitate extraction of subterranean hydrocarbons therein. Some embodiments include a wellbore configured to extend into the geologic structure including at least one well casing, a first electrode disposed within the wellbore, at least one second, or auxiliary, electrode coupled to the first electrode, an ionically conductive medium in fluid communication with at least the first electrode, and a power source electrically connected to the first electrode and at least one auxiliary electrode configured to establish an electrical current therebetween.

Some embodiments of the present systems (e.g., to facilitate extraction of subterranean hydrocarbons from a geologic structure through a wellbore extending at least partially through the geologic structure) comprise: a first electrode disposed within the wellbore, the first electrode comprising an interface for an ionically conductive medium in fluid communication with the first electrode; a second electrode coupled to the first electrode; and a power source configured to establish an electrical current between the first and second electrodes to cause an electrochemical reaction. In some embodiments, the geologic structure comprises one or more of: a shale formation, a siltstone formation, a sandstone formation, and/or a conglomerate formation. In some embodiments, the subterranean hydrocarbons comprise one or more of: natural gas, natural gas liquids, kerogen, coal seam gas, tight gas, shale gas, tight oil, shale oil, coal bed methane, and/or gas hydrates. In some embodiments, the second electrode is positioned within the wellbore. In some embodiments, the second electrode is configured as an earth grounding conductor.

Some embodiments of the present methods (e.g., to facilitate extraction of subterranean hydrocarbons from a geologic structure) comprise: positioning a first electrode within a wellbore that extends into the geologic structure; providing a second electrode coupled to the first electrode; utilizing an ionically conductive medium in fluid communication with at least the first electrode; and passing an electrical current between the first and second electrodes and through an ionically conductive medium the first electrode to cause an electrochemical reaction. In some embodiments, the geologic structure comprises one or more of: a shale formation, a siltstone formation, a sandstone formation, and/or a conglomerate formation. In some embodiments, the subterranean hydrocarbons comprise one or more of natural gas, natural gas liquids, kerogen, coal seam gas, tight gas, shale gas, tight oil, shale oil, coal bed methane, and/or gas hydrates. In some embodiments, the electrochemical reaction induces fractures within the geologic structure. In some embodiments, the electrochemical reaction increases subterranean pressures. In some embodiments, the electrical current is regulated in at least one of a plurality of operation modes.

Some embodiments of the present systems (e.g., to induce fractures in a geologic structure to facilitate extraction of subterranean hydrocarbons therein through a wellbore extending at least partially through the geologic structure) comprise: a first electrode disposed within the wellbore, the first electrode comprising an interface for an ionically conductive medium in fluid communication with the first electrode; a second electrode coupled to the first electrode; and a power source configured to establish an electrical current between the first and second electrodes to cause an electrochemical reaction. In some embodiments, the geologic structure comprises one or more of: a shale formation, a siltstone formation, a sandstone formation, and/or a conglomerate formation. In some embodiments, the subterranean hydrocarbons comprise one or more of: natural gas, natural gas liquids, kerogen, coal seam gas, tight gas, shale gas, tight oil, shale oil, coal bed methane, and/or gas hydrates. In some embodiments, the second electrode is positioned within the wellbore. In some embodiments, the second electrode is configured as an earth grounding conductor. Some embodiments further comprise at least one supplementary wellbore comprising at least one auxiliary electrode disposed therein. In some embodiments, a component of the ionically conductive medium naturally exists within the geologic structure. In some embodiments, the ionically conductive medium comprises water. In some embodiments, the wellbore comprises a well casing. In some embodiments, the well casing is perforated. In some embodiments, the well casing is configured as a current collector associated with the first or second electrode. In some embodiments, the well casing is configured to function as an electrode. In some embodiments, a second well casing is positioned within the first well casing and a separation material is interposed between the first and second well casings. In some embodiments, the separation material comprises one or more of: an ionically conductive medium and/or an electrically insulating medium. In some embodiments, at least one of the first and second electrodes comprises one or more of: electrically conductive granular materials, electrically conductive proppant materials, and/or electrocatalytic materials. Some embodiments further comprise: a catalytic material configured to facilitate a combustion reaction involving at least one product of an electrochemical reaction. Some embodiments further comprise: one or more well plugs configured to separate segments of the wellbore and facilitate segmented extraction of the subterranean hydrocarbons.

In some embodiments of the present systems, the power source is configured to provide electrical current between the first electrode and the second electrode. In some embodiments, the power source is configured to provide alternating current between the first electrode and the second electrode. In some embodiments, the alternating current is configured to produce alternating subterranean pockets of at least two electrochemical reaction products. In some embodiments, the power source is configured to operate in any of a plurality of operation modes. In some embodiments, the operation modes are configured to be controlled by or responsive to at least one of: user command, programming, sensed data, and/or elapsed time. In some embodiments, the system is configured to operate over an initial extraction period. In other embodiments, the system is configured to operate over a lifetime of the wellbore.

Some embodiments of the present methods (e.g., to induce fractures in a geologic structure to facilitate extraction of subterranean hydrocarbons) comprise: positioning and a first electrode within a well casing of wellbore the extends into a geologic structure; providing a second electrode coupled to the first electrode; and passing, with a power source, an electrical current between the first and second electrodes and through an ionically conductive medium to cause an electrochemical reaction. In some embodiments, the geologic structure comprises one or more of: a shale formation, a siltstone formation, a sandstone formation, and/or a conglomerate formation. In some embodiments, the subterranean hydrocarbons comprise one or more of natural gas, natural gas liquids, kerogen, coal seam gas, tight gas, shale gas, tight oil, shale oil, coal bed methane, and/or gas hydrates. Some embodiments further comprise: positioning the second electrode within the wellbore. In some embodiments, the second electrode is configured as an earth grounding conductor. In some embodiments, at least one component of the ionically conductive medium naturally exists within the geologic structure. In some embodiments, the electrochemical reaction products increase subterranean pressures. In some embodiments, sorption of at least one electrochemical reaction product by at least a portion of the geologic structure displaces at least a portion of the subterranean hydrocarbons. In some embodiments, at least one electrochemical reaction product reacts in a combustion reaction. In some embodiments, the well casing is perforated. In some embodiments, the well casing is configured as a current collector associated with an electrode. In some embodiments, the well casing is configured to function as an electrode. In some embodiments, a second well casing is disposed within the first well casing and a separation material is disposed between the first and second well casings. In some embodiments, the separation material comprises one or more of: an ionically conductive medium and/or an electrically insulating medium. In some embodiments, at least one of the first and second electrodes comprises one or more of: electrically conductive granular materials, electrically conductive proppant materials, and/or electrocatalytic materials. Some embodiments further comprise: placing well plugs within the first wellbore to separate segments of the first wellbore, thereby facilitating segmented extraction of the subterranean hydrocarbons.

In some embodiments of the present methods, the electrical current comprises direct electrical current. In some embodiments, the electrical current comprises alternating electrical current. In some embodiments, the alternating electrical current produces alternating subterranean pockets of at least two electrochemical reaction products. Some embodiments further comprise operating the power source in at least one of a plurality of operation modes. In some embodiments, at least one of the plurality of operation modes is controlled by or responsive to at least one of: user command, programming, sensed data, and elapsed time. Some embodiments further comprise: utilizing the power source over an initial extraction period. Other embodiments further comprise: utilizing the power source over a lifetime of the wellbore. In some embodiments, at least one electrochemical reaction lowers a concentration of impurities in extracted hydrocarbons compared to a concentration of impurities naturally present in the subterranean hydrocarbons.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1:
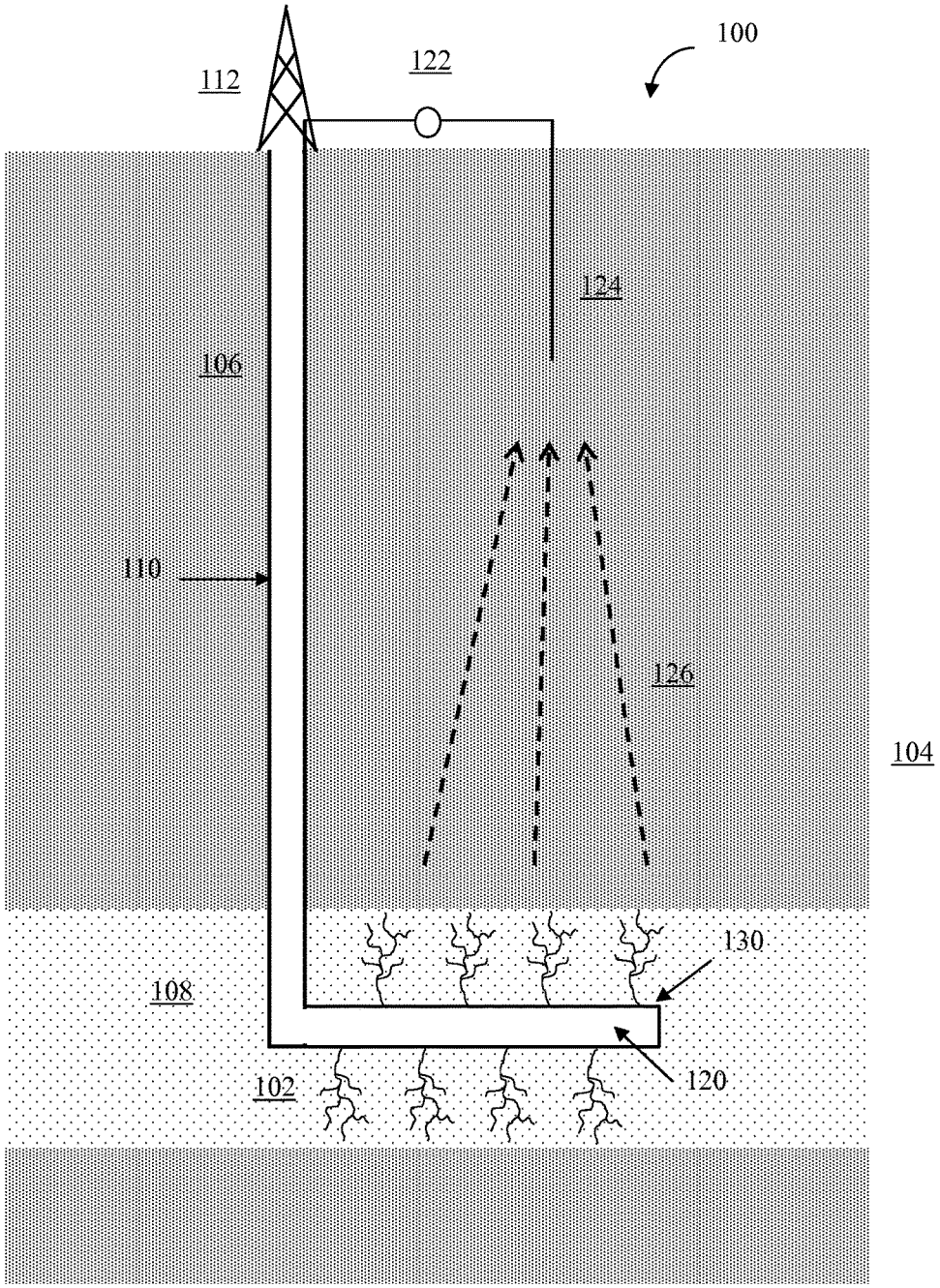
FIG. 1 illustrates a cross-sectional view of a geologic structure with an embodiment of the present systems for facilitating extraction of subterranean hydrocarbons from a geologic structure.

Some embodiments of the present systems and methods can be configured to facilitate extraction of subterranean hydrocarbons from geologic structures with the use of electrochemical processes. Non-limiting examples of geologic structures include: shale formations, siltstone formations, sandstone formations, and conglomerate formations. The subterranean hydrocarbons may be in the form of petroleum (i.e., liquid), natural gas, natural gas liquids, kerogen, coal seam gas, tight gas, shale gas, tight oil, shale oil, coal bed methane, gas hydrates or a combination thereof. In some embodiments, the subterranean hydrocarbons include natural gas. In some embodiments, electrochemical processes are used to induce fractures within the geologic structure. One feature described herein for certain embodiments is that extraction may be regulated "at will", that is hydrocarbons may be extracted in a variety of modes (e.g., intermittently and/or selectively and/or at varying levels of intensity). An additional feature of at least some of the present embodiments is that electrochemical processes may be used to readily control down-bore pressure, that pressure being regulated, for example, by current flowing through the electrodes.

Certain conventional supplementary recovery methods like hydraulic fracturing transfer energy downbore via compressed fluids to crack deep rock as a result of subterranean pressures up to 15,000 psi, which may be generated, for example, via compressors. New techniques are provided via the embodiments described herein for transferring energy downbore for hydrocarbon extraction through the use of electrochemical processes. It will be appreciated from this disclosure that high pressures may be generated with electrochemical cells, as the pressure ratio is exponential in the overpotential ($\eta$). For example, at temperatures (T) close to around approximately 400 K (due to elevated underground temperatures around 10,000 ft below ground), the quantity RT/F is equal to 34 mV (R representing the ideal gas constant and F representing Faraday's constant). Applying the Nernst equation, the achievable pressure multiple as a function of overpotential is equal to $e^{(\eta/34\ [mV])}$. This implies that a modest overpotential around 200-300 mV could achieve conventional fracturing pressures. It may be further appreciated that electrochemical pressure generation can simplify fracturing fluid compression and lower costs, further enhancing the economics of unconventional shale oil and gas formations.

Geologic structures may include formations of any type, thickness, depth, layering strata, porosity, permeability, and/or the like. In some embodiments, at least a portion of the geologic structure contains subterranean hydrocarbons, such as natural gas or oil, trapped in shale formations. In some embodiments, at least one electrochemical reaction induces fractures within at least a portion of a shale formation. In addition to natural gas, liquid hydrocarbons (i.e., oil) may be extracted from shale formations or "wet wells." For example, "tight oil" naturally occurring in shale formations, "shale oil" produced from kerogen, and/or "coal seam gas" produced from coal beds, may also be extracted according to embodiments described herein. The subterranean hydrocarbons specified herein are for exemplary purposes and are not intended to be limiting in any way.

Extraction of subterranean hydrocarbons may be facilitated through the use of electrochemical processes either directly or indirectly. In some embodiments, an electrochemical reaction may increase subterranean pressures, temperatures and/or heat which may directly facilitate extraction of the hydrocarbons by fracturing hydrocarbon-trapping formations, by altering the properties of the hydrocarbons themselves (e.g. viscosity, density, chemical composition) by using pressure to overcome surface tension trapping or a combination thereof.

In some embodiments, the extraction of hydrocarbons may be facilitated indirectly by follow-up processes involving electrochemical reaction products. For example, sorption of electrochemical reaction products by the hydrocarbon-trapping formations may displace subterranean hydrocarbons, thus facilitating extraction of the subterranean hydrocarbons. As another example, electrochemical reaction products may further undergo chemical conversion in a combustion reaction. Energy associated with a combustion reaction may fracture hydrocarbon-trapping formations. Furthermore, combustion reaction products may alter properties of the subterranean hydrocarbons to facilitate extraction. For example, carbon dioxide may act as an Enhanced Oil Recovery or "EOR" agent by reducing hydrocarbon viscosity.

The foregoing processes are meant to be exemplary and in no way limit the potential processes occurring upon generating electrochemical reactions within a wellbore.

In accordance with one embodiment, FIG. 1 depicts a system 100 that is configured to induce fractures 102 in at least a portion of a geologic structure 104 to facilitate extraction of subterranean hydrocarbons therein. A wellbore 106 may be drilled into geologic structure 104, reaching a portion of the geologic structure including subterranean hydrocarbons 108. In the embodiment shown, well casings (generally indicated at 110) may be installed in the wellbore 106. Well casings are known in the petroleum engineering arts and commonly include metal tubes to strengthen the wellbore 106 and/or ensure hydrocarbons are brought to the wellhead 112. In some embodiments, well casings 110 may be perforated (e.g., and thereby providing access to subterranean hydrocarbon formations in addition to creating hydrocarbon flow pathways for extraction).

In the exemplary embodiment of FIG. 1, a first electrode 120, for example made of a conductive metal in electrical communication with and/or comprising disperse carbon granular materials, and having dimensions ranging from several centimeters to meters in diameter and thickness and ranging from meters to kilometers in length, can be and is generally depicted to be disposed within wellbore 106. In the embodiment shown, electrode 120 may be coupled to a second or auxiliary electrode 124 and electrically connected to a power source 122. Power source 122 may be further connected to second, or auxiliary, electrode 124. In the illustrated embodiment, second electrode 124 is an earth grounding electrode, however other arrangements of electrodes can be made, as will be discussed later. The use of an earth grounding electrode (e.g., 124) is entirely optional.

In the illustrated embodiment of FIG. 1, the power source 122 is configured to pass a current indicated generally as 126, such as, for example, of current densities ranging from about 1 mA/cm$^2$ to about 100 A/cm$^2$) between first electrode 120 and auxiliary earth grounding electrode 124. Current 126 may cause an electrochemical reaction at the interface (e.g., boundary) between the first electrode 120 and an ionically conductive medium generally indicated at 130 in FIG. 1.

The ionically conductive medium (130) may include any suitable component; with the primary characteristic that it conduct ions. For example, the ionically conductive medium may include aqueous solvents, nonaqueous solvents, ionic liquids, anions, cations, neutral species, minerals, dissolved gasses, ion-exchange materials, membranes, their derivatives and combinations thereof. In some embodiments, the ionically conductive medium (130) comprises an aqueous electrolyte solution including ions at acidic, basic or neutral pH. In some embodiments, ionically conductive medium 130 may include components which naturally exist within the geologic structure. For example, the electrolyte may include connate fluids including water and minerals. In some embodiments, components of the ionically conductive medium (130) may be transported from the surface into wellbore 106 (e.g., by a pump or any other suitable structure). In some embodiments, components of the ionically conductive medium may be transported into supplementary wellbores and/or around auxiliary, secondary, and/or earth grounding electrode(s) (e.g., 124).

In some embodiments, components of the ionically conductive medium can be electrolyzed in an electrochemical reaction to produce electrochemical reaction products. As a non-limiting example, water may be electrolyzed in acidic, basic, or neutral media to produce hydrogen gas at an electrode (e.g., operating as a cathode) and oxygen gas at an electrode (e.g., operating as an anode). For example, for basic media, the cathodic reaction can be expressed as in Equation 1 and the anodic reaction can be expressed as in Equation 2:

$$4H_2O+4e^- \rightarrow 2H_2(g)+4OH^- E^0=-0.828\text{V vs NH}E, \quad (1)$$

$$4OH^- \rightarrow O_2(g)+2H_2O+4e^- E^0=0.401\text{V vs NH}E. \quad (2)$$

In acidic media, the cathodic reaction can be expressed as in Equation 3 and the anodic reaction can be expressed as in Equation 4:

$$4H^++4e^- \rightarrow H_2(g) E^0=0.00\text{V vs NH}E, \quad (3)$$

$$2H_2O \rightarrow O_2(g)+4H^++4e^- E^0=1.229\text{V vs NH}E. \quad (4)$$

In some embodiments (e.g., 100), electrocatalysts may be employed to facilitate electrochemical reactions.

In some embodiments, an electrochemical reaction may lower a concentration of impurities in extracted hydrocarbons compared to a concentration of impurities naturally present in subterranean hydrocarbons. As a non-limiting example, hydrogen sulfide is a known impurity that may be electrolyzed (e.g., decomposed) in an electrochemical reaction. Depending on the desired operating characteristics, certain impurities may be targeted by altering components of the electrodes, ionically conductive medium, catalysts and/or power source operating conditions. For example, hydrogen sulfide can be decomposed by electrolysis.

In some embodiments (e.g., 100), gaseous electrochemical reaction products may increase and/or establish high subterranean temperatures and/or pressures which can facilitate extraction of the subterranean hydrocarbons. High subterranean pressures (e.g., pressures up to 30,000 psi and, in some instances, up to about 100,000 psi), may fracture hydrocarbon-trapping formations, thereby releasing the hydrocarbons confined therein. Additionally, such high level temperatures (e.g., greater than about 500 K) may lower the viscosity of subterranean hydrocarbons, thereby facilitating flow.

Large capillary forces, which may trap hydrocarbons in shale formations, may be present due to small pores sizes (e.g., 0.001-100 micron). For example, hydrocarbon flow may be induced if pressures resulting from electrochemical processes are high enough to overcome such capillary forces constraining hydrocarbon release.

Furthermore, electrochemical reaction products may also displace and/or otherwise interact with subterranean hydrocarbons to facilitate extraction. Sorption of electrochemical reaction products by a portion of the geologic structure may, for example, result in displacement of hydrocarbons, thereby stimulating flow. For example, electrochemical products may displace hydrocarbons adsorbed within subterranean formations by a competitive adsorption effect.

Electrochemical reaction products may further undergo chemical conversion in a combustion reaction, producing combustion products. For example, hydrogen and oxygen from water electrolysis may explosively recombine. In some embodiments, subterranean hydrocarbons may also undergo chemical conversion in a combustion reaction with oxygen produced from water electrolysis. High transient temperatures and/or pressures associated with a combustion reaction may facilitate fracture of hydrocarbon-trapping formations and/or may overcome capillary forces constraining hydrocarbon release. Furthermore, combustion reaction products may alter properties of the subterranean hydrocarbons to facilitate extraction. For example, carbon dioxide may reduce hydrocarbon viscosity. As another example, sorption of combustion reaction products may also displace hydrocarbons.

The foregoing processes are provided as non-limiting examples. Accordingly, the present embodiments of processes and systems for facilitating hydrocarbon extraction are not meant to be bound by any particular theory.

In the exemplary embodiment of FIG. 1, a first electrode 120 is coupled, such as, for example, by a current collector (e.g., provided as a well casing) to a second, or auxiliary, electrode 124 depicted as an earth grounding electrode, however, in other embodiments, an earth grounding electrode 124 may be excluded. In some embodiments, supplementary wellbores may be provided, each including at least one auxiliary electrode. In some embodiments, a plurality of electrodes may be provided in any number of wellbores and/or any number of electrode(s) can be configured as earth grounding electrodes. Numerous arrangements of electrodes and associated cell configurations can be made. Some exemplary configurations will now be described; however, the configurations described herein are not meant to be limiting, but instead demonstrate the versatility of the disclosed subject matter.

Figure 2:
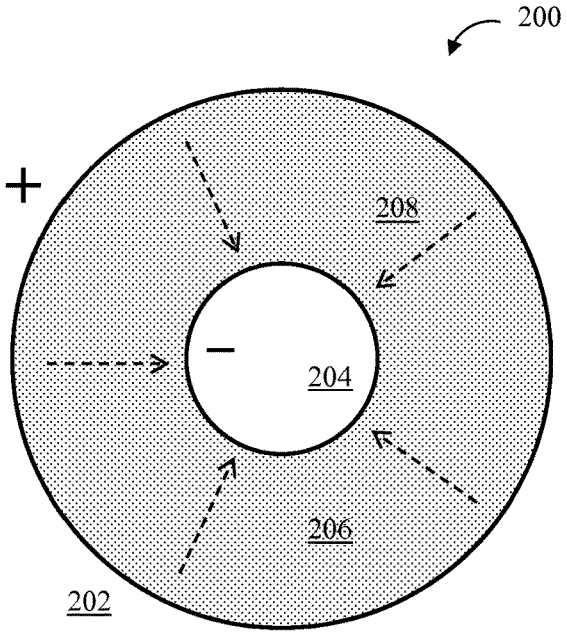
FIG. 2 illustrates a cross-section of an example of one of the present cylindrical cell configurations, as viewed down a wellbore axis.

In some embodiments, a plurality of electrodes may be disposed within a single wellbore. For example, FIG. 2 illustrates a cross-section of a first embodiment 200 of a cell having two electrodes in a cylindrical configuration in the wellbore axis. In the embodiment shown, cylindrical cell 200 comprises two concentric electrodes 202 and 204 with each formed as a hollow cylinder. In the embodiment shown, a first electrode 202 is coupled to a second, or auxiliary, electrode 204. In this example, two electrodes are depicted, however, any suitable number of electrodes may be provided.

In some embodiments, a well casing (e.g., 110) may be configured to collect current associated with an electrode. In other embodiments, a well casing (e.g., 110) may be configured to function as the electrode itself. For example, the well casing of the wellbore may function as first electrode 202. The well casing functioning as the first electrode 202 may be perforated and/or otherwise suitably shaped to facilitate access to hydrocarbon formations.

In the embodiment shown, the annulus of cylindrical cell 200 may include a separation material 206. For example, in the embodiment shown, the separation material may include an ionically conductive medium generally indicated at 206. The ionically conductive medium 206 may be flowing or substantially static. The ionically conductive medium may include solid-state ion-exchange materials or any suitable membrane materials (e.g., polypropylene, polyethylene, Nafion, and/or the like).

In the illustrated embodiment, first electrode 202 and auxiliary electrode 204 may be electrically connected to a power source (not depicted in FIG. 2) configured to pass an electrical current (generally indicated by arrows 208) through ionically conductive medium 206. The current (208) may cause an electrochemical reaction at the interface (e.g., boundary) between first electrode 202 and ionically conductive medium 206. The current 208 may also cause an electrochemical reaction at the interface between secondary or auxiliary electrode 204 and ionically conductive medium 206.

In the embodiment shown, ionically conductive medium 206 may include water which can be electrolyzed at first electrode 202 functioning as a cathode to produce gaseous hydrogen. Furthermore, auxiliary electrode 204 functioning as an anode may electrolyze water to produce gaseous oxygen. The resulting products may facilitate extraction of hydrocarbons by any number of processes previously described by example above.

In some embodiments, the ionically conductive medium may be continuous. In other embodiments, ionically conductive medium 206 may be partitioned. For example, ionically conductive medium 206 may include an anolyte (e.g., associated with an electrode operating as an anode) and a catholyte (e.g., associated with an electrode operating as a cathode). While a single compartment having an ionically conductive medium 206 is depicted in the cell 200, any suitable partitioning of the ionically conductive medium can be achieved via a physical barrier, designed flow characteristics or otherwise.

Figure 3A:
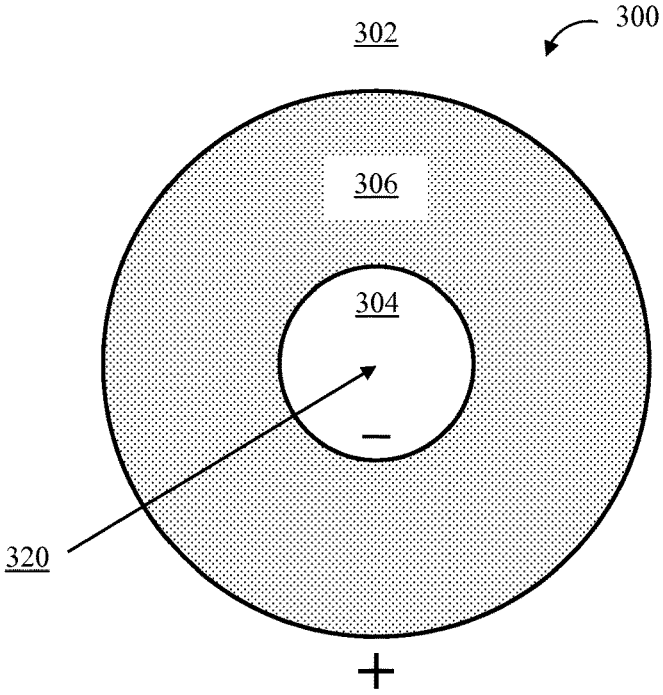
FIG. 3A illustrates a cross-section of an example of the present linear cell configurations, as viewed down a wellbore axis.
Figure 3B:
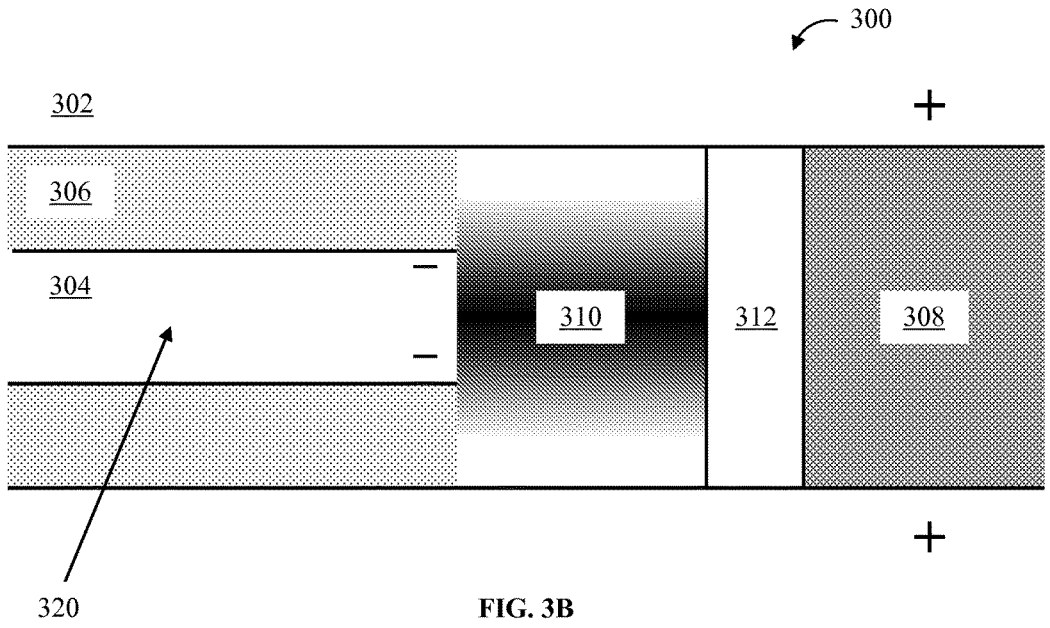
FIG. 3B illustrates a cross-section of the linear cell configuration of FIG. 3A, as viewed perpendicular to a wellbore axis.

Numerous electrode and cell configurations can be used in embodiments having a plurality of electrodes disposed within a single wellbore. For example, FIG. 3A and FIG. 3B illustrate a linear cell configuration 300. FIG. 3A illustrates a cross-section of linear cell 300 as viewed down a wellbore axis and FIG. 3B illustrates a cross-section of linear cell 300 as viewed perpendicular to the wellbore axis. In the embodiment shown, linear cell 300 includes two concentric electrodes (308 and 310) formed as hollow cylinders. In the embodiment of FIG. 3A, a current collector 302 is associated with first electrode 308. As shown, first electrode 308 can be coupled to a current collector 304 associated with a second and/or auxiliary electrode 310. In the embodiment shown, the first electrode current collector 302 and/or the auxiliary electrode current collector 304 may include well casings (e.g., hollow steel tubes).

In the embodiment shown, the annulus of linear cell 300 (e.g., formed at least in part by current collectors 302 and 304) may include a separation material. For example, the separation material may include an electrically insulating medium generally indicated at 306. The electrically insulating medium may include any suitable insulating material. For example, the electrically insulating medium may include cement, concrete, aggregate, mortar or any other suitable material. In the illustrated embodiment current collector 302 may extend to a predetermined depth (e.g., from about 1,000 ft to several miles) into the wellbore, reaching the first electrode 308. Furthermore, the auxiliary electrode current collector 304 may extend to a predetermined depth into the wellbore, reaching the auxiliary electrode generally indicated at 310. In the embodiment shown, cell 300 further comprises a diaphragm 312 (e.g., including an ionically conductive medium) which may be positioned between first electrode 308 and auxiliary electrode 310 and configured to conduct ions therebetween. In the example of FIG. 3B, two electrodes are depicted, however, any suitable number of electrodes may be provided.

In the illustrated embodiment first electrode 308 and auxiliary electrode 310 may be electrically connected to a power source (not depicted in FIG. 3B) configured to pass an electrical current through diaphragm 312. For example, in the embodiment shown, such current may cause an electrochemical reaction at surfaces associated with the first electrode 308. Additionally, the current may cause an electrochemical reaction at surfaces associated with auxiliary electrode 310. In the embodiment shown, first electrode 308 may extend (e.g., physically or functionally) into hydrocarbon-rich formations through the use of granular materials, as will be described below.

Electrodes of the present systems, cells, and/or methods may comprise any suitable configuration and include any suitable material. In some embodiments, electrodes may include electrically conductive granular material. Such electrically conductive material may be any suitable material, with the primary characteristic that the material be electrically conductive. For example, the electrically conductive granular material may include conductive carbons (e.g. graphite, charcoal, coke, carbon black, and/or the like). It should be appreciated that such granular material may substantially function as an electrode, providing high electrode surface areas that can extend into hydrocarbon-rich formations. It will also be appreciated that the granular material may be chosen for its catalytic activity, or its selectivity towards a particular electrochemical reaction, thereby enhancing the desired effect of the electrochemical process. Electrically conductive granular materials may be transported into the wellbore by any suitable means. For example, the granular material may be provided in the wellbore via a pump. As a non-limiting example described in accordance with FIG. 3B, granular material associated with the first electrode 308 may be disposed (e.g., pumped) into the wellbore, and the diaphragm 312 may be disposed in the wellbore substantially above (e.g., on top of) the granular material. In some embodiments, the diaphragm 312 may be configured to compress the granular materials to a predetermined density thus forming the structure of the first electrode (e.g., 308). In some embodiments, suitable materials may be transported into the wellbore in a stepwise fashion, for example, through a central channel 320.

In various embodiments, electrodes may include electrically conductive proppant materials. For example, before, during, and/or after fracturing, the electrically conductive proppant materials may be injected into the wellbore to keep induced fractures open. In some embodiments, the electrically conductive proppants can be permeable to gas (e.g., when under high subterranean pressures). The proppant packing density can be configured to facilitate electrical conduction, gas permeability, and mechanical stability to withstand closure pressures. The electrically conductive proppant materials may be composed of any suitable material; with the primary characteristic that they are electrically conductive. For example, the electrically conductive proppant materials may be metals, semi-metals, metal alloys, carbon-based materials, their derivatives and combinations thereof. The electrically conductive proppant materials may be of any suitable dimension. For example, the proppant materials can comprise an assortment of grain sizes from fine to coarse, which may be configured to facilitate conductivity and/or fracture support. Furthermore, such particles may be solid, porous, hollow, jagged, and/or combinations thereof. In some embodiments, the electrically conductive proppant material comprises carbon particulate materials.

In some embodiments, electrodes may include electrocatalytic material configured to facilitate electrochemical reactions. Any electrocatalytic material may be employed, with the primary characteristic that the material is capable of lowering an overpotential associated with an electrochemical reaction. Such electrocatalytic materials can also be low cost. For example, electrocatalytic materials may include metals, metal oxides, metal alloys, doped metal oxides, perovskites, nitrides, and/or the like In some embodiments, the electrocatalytic material comprises one or more of platinum, palladium, carbon, iron, nickel, cobalt, ruthenium dioxide, and/or the like.

As described above, the extraction of hydrocarbons may be facilitated indirectly by follow-up processes involving electrochemical reaction products For example, electrochemical reaction products may further undergo chemical conversion in combustion reactions. While embodiments of the present disclosure are not bound by any particular theory, combustion reactions may result in fracturing of hydrocarbon-trapping formations and/or altering of subterranean hydrocarbon properties, thereby facilitating extraction. For example, gaseous oxygen (e.g., which can be produced in electrochemical water electrolysis) may act as an oxidizer in a follow-up combustion reaction. Furthermore, gaseous hydrogen (e.g., produced in electrochemical water electrolysis) may act as a fuel in a follow-up combustion reaction. In some embodiments, hydrocarbons (e.g., present in subterranean formations) may act as fuels in combustion reactions, a process which is known as "fireflooding" in the petroleum engineering arts. In some embodiments, catalytic materials that can facilitate combustion reactions may be provided within the wellbore. Non-limiting examples of catalytic materials may include metals, semi-metals, metal oxides, metal alloys, mixed metal oxides, ceramics, perovskites, zeolites and/or the like In some embodiments, the catalytic material comprises one or more of platinum, palladium, carbon, iron, nickel, cobalt, ruthenium dioxide, manganese oxide, and/or the like.

In some embodiment, certain materials known in the petroleum engineering arts may be injected into the wellbore to facilitate hydrocarbon extraction. For example, tracer materials (e.g. radioactive isotopes) may be injected into the wellbore to determine the location of fractures. As another example, conventional proppant materials (e.g. sands, ceramic, glass, and/or the like) may also be injected into the wellbore to keep induced fractures open.

In some embodiments, conventional systems and/or methods known in the petroleum engineering arts may be used in addition to those described herein. As a non-limiting example, conventional hydraulic fracturing may be performed with the use of an electrically conductive proppant material. The electrically conductive proppant may then be employed (e.g., to function as) as an electrode.

In some embodiments, components of the electrodes, components of the ionically conductive medium, electrically insulating materials, proppants, electrocatalysts, catalysts, and/or other suitable materials, and/or the like may be transported from the wellhead into the wellbore through any suitable channel (e.g., 320) and through use of any suitable structure, such as transporting from the surface via a pump. Some embodiments of the present methods include depositing these materials in a coordinated fashion (e.g., to form at least one electrochemical cell in any suitable configuration). Thus, embodiments of the present processes may be performed in a stepwise manner, both on initial extraction and/or throughout the lifetime of the wellbore.

It will be appreciated that definitions (i.e. physical boundaries and/or electrochemical processes) of the electrodes and ionically conductive medium may change depending on desired operating conditions and/or over the lifetime of the wellbore. For example, over time, materials of varied properties may be injected into the wellbore, thus altering the definitions of the electrodes and/or associated cell configuration.

As an example, segmented fracturing may constantly change the definitions of the electrodes. Well plugs are known in the petroleum engineering arts. In some embodiments, well plugs may be configured to separate segments of a wellbore to facilitate extraction of subterranean hydrocarbons in sections. The specifics of each extraction system and process may be dependent on, for example, the particulars of the hydrocarbon formation, desired operating conditions, wellbore maturation and/or the like. Accordingly, configurations of the present systems, cells, and/or the like, and particular methods described herein are purely exemplary.

As described above, in some embodiments, the power source (e.g., 122) is configured to supply power down-bore to generate at least one electrochemical reaction. The power source may be configured to pass an electrical current between a first electrode and at least one auxiliary electrode. Such current may be a direct current, an alternating current, or a combination thereof. In some embodiments, an alternating current may produce alternating subterranean pockets of at least two electrochemical reaction products.

Figure 4:
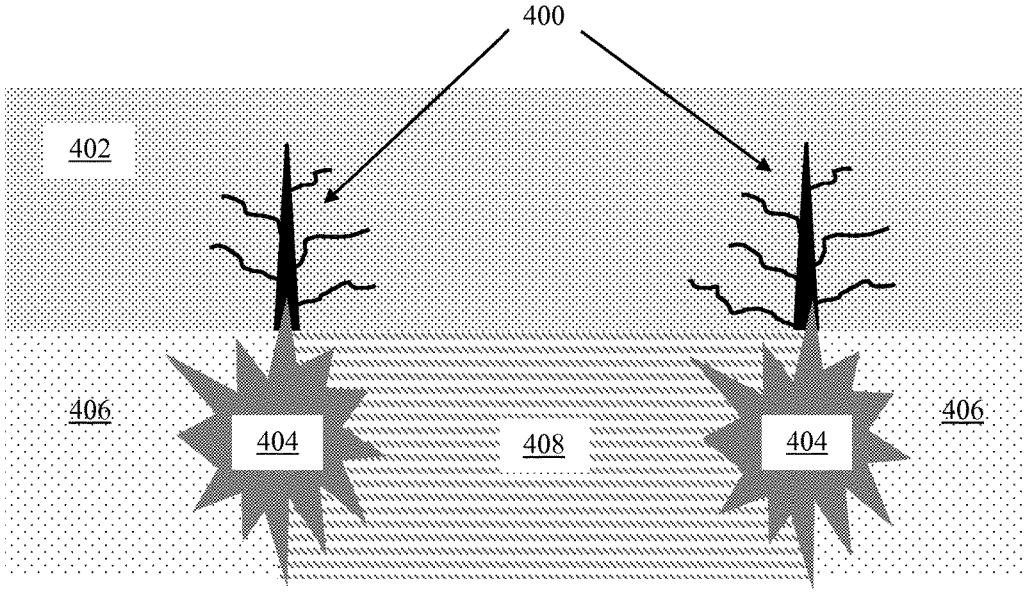
FIG. 4 illustrates a cross-sectional view of an example of fracture propagation within a geologic structure containing subterranean hydrocarbons, induced by combustion of alternating pockets of electrochemical reaction products.

FIG. 4 illustrates a cross-sectional side view of fracture propagation 400 within a geologic structure 402 including subterranean hydrocarbons. In the illustrated embodiment, fractures 400 are induced by energy associated with a combustion reaction generally indicated at 404. In the embodiment shown, electrodes in any suitable configuration may electrolyze components of an ionically conductive medium to produce alternating pockets of electrochemical reaction products. For example, water may be electrolyzed to form alternating pockets of gaseous hydrogen 406 and gaseous oxygen 408 which may explosively recombine in a combustion reaction 404. The energy associated with the combustion reaction may induce (e.g., or expand) fractures 400. Additionally, such combustion reaction products may further enhance extraction of subterranean hydrocarbons. For example, carbon dioxide may reduce the viscosity of the hydrocarbons, facilitating flow thereof. The simplified process depicted in FIG. 4 is meant to be exemplary as numerous other arrangements and processes can be made.

In some embodiments, the system may be configured to facilitate positioning of the electrode set. For example, at least one electrode may be disposed on the head of a drill pipe (e.g., to allow for local dispensation of power from the power source into the wellbore).

The present systems and methods described herein may be configured to operate over an initial extraction period of a wellbore. Furthermore, the present systems and methods may be configured to operate over the lifetime of the wellbore. That is to say, systems and methods described herein are not limited to any particular interval in the operational trajectory or lifespan of a wellbore. An advantageous feature of at least some of the systems and methods described herein is that extraction may be regulated "at will." As such, in some embodiments, hydrocarbons may be extracted in a variety of operational modes. For example, in some embodiments, the power source may operate between an idle mode and a current generating mode (e.g., which may be intermittent and/or selective). Furthermore, in some embodiments, the power source may regulate hydrocarbon extraction at varying levels of intensity such as, for example, controlled programmatically (e.g., via a processor and processor-executable instructions), by user command (e.g., via a user input device), by sensing a data element (e.g., via one or more sensors), after an elapsed time (e.g., via a processor and/or timer), and/or any other suitable control mechanism.

Figure 5:
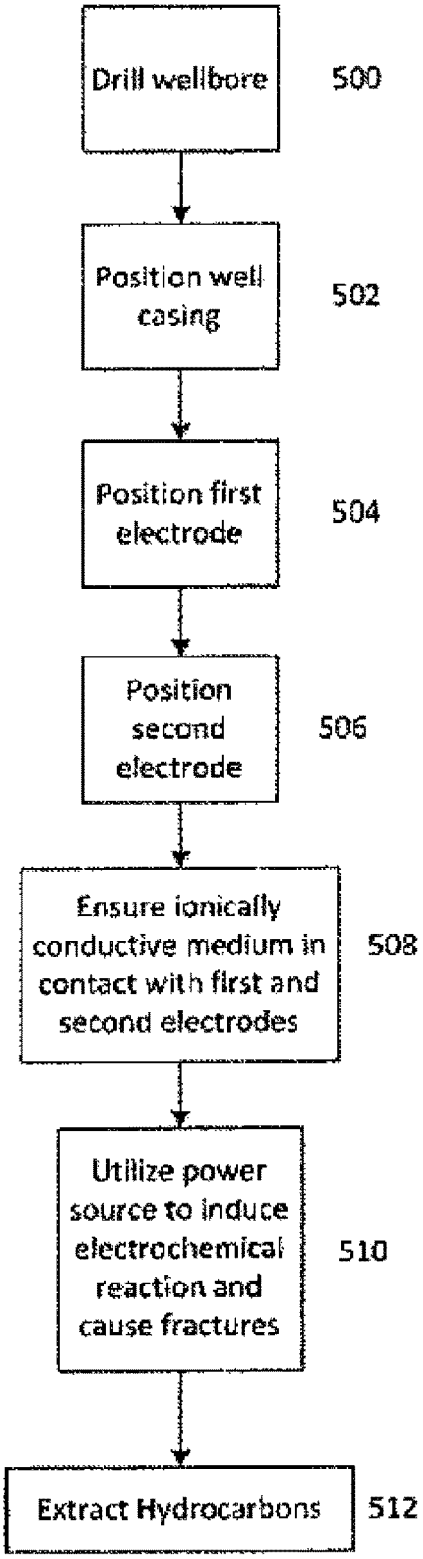
FIG. 5 shows a flowchart of an exemplary method for facilitating hydrocarbon extraction in accordance with certain aspects of the disclosed subject matter.

FIG. 5 depicts a flow chart of an exemplary method for facilitating hydrocarbon extraction in accordance with the disclosed subject matter. Initially, in the embodiment shown, at least one wellbore can be provided which extends into the geologic structure at a step 500. In the embodiment shown, a well casing can be subsequently provided at a step 502. In this embodiment, a first electrode may be positioned within the wellbore at a depth determined, for example, by the depth of a hydrocarbon formation at a step 504. At a step 506, a second electrode may be coupled to the first electrode. In some embodiments, a second electrode may be positioned in the wellbore. In some embodiments, the second electrode may be an earth grounding electrode. In the embodiment shown, at a step 508, an ionically conductive medium can be placed into contact (e.g., electrical contact) with at least one of the first electrode and second electrode. In some embodiments, connate fluids present in the wellbore can compose the ionically conductive medium. As shown, at a step 510, a power source can be utilized to pass an electrical current between the first and second electrode wherein the electrical current causes at least one electrochemical reaction. In the embodiment shown, hydrocarbons may be extracted at a step 512. In some embodiments, any ionically conductive medium may be repositioned or recovered before extraction of the hydrocarbon. In some embodiments, this process may be repeated any number of times.

As a non-limiting example, subterranean pressures, or any other suitable metric associated with wellbore production characteristics, may be measured by monitoring a potential difference between the first electrode and at least one auxiliary electrode. For example, a measured potential may be used as indicator of steady-state and/or dynamic down-bore pressures. For example, a measured potential may be used to calculate the downbore pressure, for example by the Nernst equation as described above. Furthermore, the power source may also be used to regulate steady-state and/or dynamic down-bore pressures. In some embodiments, electrochemical processes may be used to readily control down-bore pressure. For example, the down-bore pressure may be increased by utilizing a power source to increase the current flowing through the electrodes. Alternatively or additionally, the down-bore pressure may be reduced by utilizing the power source to decrease the current flowing through the electrodes. Various other data elements may be measured and monitored depending on the desired operating characteristics. Additionally, down-bore pressure and/or any other suitable metric associated with wellbore production characteristics may be regulated by any suitable control mechanism (e.g., pressures, temperatures, currents, potentials, and/or the like may be regulated by PID control, servos and/or the like).

The foregoing illustrated embodiments have been provided solely for illustrating the functional principles of the disclosed subject matter and are not intended to be limiting. For example, the present invention may be practiced using different overall structural configuration, materials, ionically conductive media, monitoring methods and/or control methods. Thus, the present invention is intended to encompass all modifications, substitutions, alterations, and equivalents within the spirit and scope of the following appended claims.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system to induce fractures in a geologic structure to facilitate extraction of subterranean hydrocarbons therein through a wellbore extending at least partially through the geologic structure, the system comprising:

i. a first electrode disposed within the wellbore, ii. wherein the first electrode comprises an interface for an ionically conductive medium in fluid communication with the first electrode, iii. a second electrode coupled to the first electrode, and iv. an auxiliary electrode disposed within the wellbore; and v. a diaphragm disposed within the wellbore between the first electrode and the auxiliary electrode and extending diametrically across the wellbore to thereby partition the wellbore;

vi. a power source connected to the first electrode and the auxiliary electrode configured to establish an electrical current through the diaphragm and adapted to cause an electrochemical reaction, where products of the electrochemical reaction increase a subterranean pressure and thereby induce a fracture in at least a portion of the geologic structure.

2. The system of claim 1, wherein the second electrode is positioned within the wellbore.

3. The system of claim 1, wherein the wellbore includes a vertical portion and a horizontal portion, and the second electrode is configured as an earth grounding conductor that is buried in the earth at a point that is above the horizontal portion of the wellbore and spaced from the vertical portion of the wellbore, but is not disposed in a second wellbore.

4. The system of claim 1, further comprising:

vii. a first current collector extending into the wellbore and associated with the first electrode;

viii. a second current collector extending into the wellbore and associated with the auxiliary electrode;

ix. an electrically insulating medium disposed between the first and second current collectors.

5. The system of claim 1, wherein a component of the ionically conductive medium naturally exists within the geologic structure.

6. The system of claim 1, wherein the well casing is configured as a current collector associated with the first electrode.

7. The system of claim 1, wherein at least one of the first and second electrodes comprises materials selected from the group consisting of: electrically conductive granular materials, electrically conductive proppant materials and electrocatalytic materials.

8. The system of claim 1, further comprising catalytic material to facilitate a combustion reaction involving at least one product of an electrochemical reaction.

9. The system of claim 1, further comprising well plugs configured to separate segments of the wellbore, thereby facilitating segmented extraction of the subterranean hydrocarbons.

10. The system according to claim 1, wherein the power source is configured to provide alternating current between the first electrode and the auxiliary electrode, and the alternating current produces alternating subterranean pockets of at least two electrochemical reaction products.

11. The system of claim 1, wherein the wellbore comprises a well casing.

12. The system of claim 11, wherein a second well casing is positioned within the first well casing, a separation material is interposed between the well casings, and the separation material is selected from the group consisting of: an ionically conductive medium and an electrically insulating medium.

13. A method to induce fractures in a geologic structure to facilitate extraction of subterranean hydrocarbons, the method comprising:

i. providing a wellbore extending into the geologic structure, ii. positioning a well casing within the wellbore, iii. positioning a first electrode within the wellbore, iv. positioning an auxiliary electrode within the wellbore; and v. positioning a diaphragm within the wellbore between the first electrode and the auxiliary electrode and extending diametrically across the wellbore to thereby partition the wellbore;

vi. providing a second electrode coupled to the first electrode, vii. utilizing an ionically conductive medium in fluid communication with at least the first electrode, and viii. utilizing a power source electrically connected to the first electrode and auxiliary electrode to pass an electrical current through the diaphragm, wherein the electrical current causes an electrochemical reaction;

ix. increasing a subterranean pressure to induce a fracture in at least a portion of the geologic structure.

14. The method of claim 13, where the well casing is associated with the first electrode to act as a first current collector, and the method further comprises:

i. positioning a second current collector within the wellbore in association with the auxiliary electrode;

ii. positioning an electrically insulating medium within the wellbore between the first and second current collectors.

15. The method of claim 13, wherein the wellbore includes a vertical portion and a horizontal portion, and the second electrode is configured as an earth grounding conductor that is buried in the earth at a point that is above the horizontal portion of the wellbore and spaced from the vertical portion of the wellbore, but is not disposed in a second wellbore.

16. The method of claim 13, wherein at least one component of the ionically conductive medium naturally exists within the geologic structure.

17. The method of claim 13, wherein the electrochemical reaction products establish high subterranean pressures.

18. The method of claim 13, wherein sorption of at least one electrochemical reaction product by a portion of the geologic structure displaces the subterranean hydrocarbons.

19. The method of claim 13, wherein at least one electrochemical reaction product reacts in a combustion reaction.

20. The method of claim 13, further comprising configuring the well casing as a current collector associated with an electrode.

21. The method of claim 13, wherein the alternating current produces alternating subterranean pockets of at least two electrochemical reaction products.

22. The method of claim 13, wherein at least one electrochemical reaction lowers a concentration of impurities in extracted hydrocarbons compared to a concentration of impurities naturally present in the subterranean hydrocarbons.

23. The method of claim 13, further comprising positioning a second well casing within the first well casing and providing a separation material therebetween, wherein the separation material comprises a medium selected from the group consisting of: an ionically conductive medium and an electrically insulating medium.

24. The method of claim 23, wherein at least one of the first and second electrodes comprises materials selected from the group consisting of: electrically conductive granular materials, electrically conductive proppant materials and electrocatalytic materials.

25. A system to induce fractures in a geologic structure to facilitate extraction of subterranean hydrocarbons therein through a wellbore extending at least partially through the geologic structure, the system comprising:

i. a first electrode disposed within the wellbore, ii. wherein the first electrode comprises an interface for an ionically conductive medium in fluid communication with the first electrode, iii. a second electrode coupled to the first electrode, and iv. a power source connected to the first electrode and second electrode configured to establish an electrical current and adapted to cause an electrochemical reaction, where products of the electrochemical reaction increase a subterranean pressure and thereby induce a fracture in at least a portion of the geologic structure;

wherein the wellbore includes a vertical portion and a horizontal portion, the first electrode is disposed in the horizontal portion, and the second electrode is configured as an earth grounding conductor that is buried in the earth at a point that is above the horizontal portion of the wellbore and spaced from the vertical portion of the wellbore, but is not disposed in a second wellbore.

* * * * *